US006257578B1

(12) United States Patent
Gulliver

(10) Patent No.: US 6,257,578 B1
(45) Date of Patent: Jul. 10, 2001

(54) ABC CHECKERS AND OTHER CHECKERS GAMES

(76) Inventor: Daniel Gulliver, 627 Pierce St., Philadelphia, PA (US) 19148

( * ) Notice: Subject to any disclaimer, the term of this patent is extended or adjusted under 35 U.S.C. 154(b) by 0 days.

(21) Appl. No.: 09/084,162

(22) Filed: May 23, 1998

(51) Int. Cl.[7] ..... A63F 3/02
(52) U.S. Cl. ..... 273/260; 273/236; 273/254
(58) Field of Search ..... 273/260, 242, 273/243, 248, 249, 258, 281

(56) References Cited

U.S. PATENT DOCUMENTS

| | | | | |
|---|---|---|---|---|
| 383,653 | * | 5/1888 | Monks | 273/258 |
| 566,307 | * | 8/1896 | Goos | 273/242 |
| 571,464 | * | 11/1896 | Truex | 273/258 |
| 809,502 | * | 1/1906 | Hale | 273/242 |
| 895,875 | * | 8/1908 | Mercer | 273/284 |
| 1,102,594 | * | 7/1914 | Kiefer | 273/260 |
| 1,474,504 | * | 11/1923 | Allen | 273/260 |
| 1,900,071 | * | 3/1933 | O'Neill | 273/258 |
| 2,273,932 | * | 4/1942 | Caesar | 273/258 |
| 3,595,580 | * | 7/1971 | Bucko | 273/260 |
| 3,902,724 | * | 9/1975 | Hersey | 273/258 |
| 3,908,998 | * | 9/1975 | Fong | 273/258 |
| 4,289,314 | | 9/1981 | Berlino | 273/260 |
| 4,552,364 | * | 11/1985 | Schaffer | 273/260 |
| 5,116,062 | | 5/1992 | Johnson | 273/260 |
| 5,160,145 | * | 11/1992 | Bokhagen | 273/260 |
| 5,642,885 | * | 7/1997 | Gustin | 273/261 |

* cited by examiner

*Primary Examiner*—Jeanette Chapman
*Assistant Examiner*—M. Chambers
(74) *Attorney, Agent, or Firm*—Susan Borden Evans

(57) ABSTRACT

Disclosed herein are checkers board games for two players. Included in this invention are variations of checkers games involving geographical facts and historical facts or personalities. These games combine the general tactics and game playing skills of checkers with knowledge of various facts and are educational in objective.

3 Claims, 17 Drawing Sheets

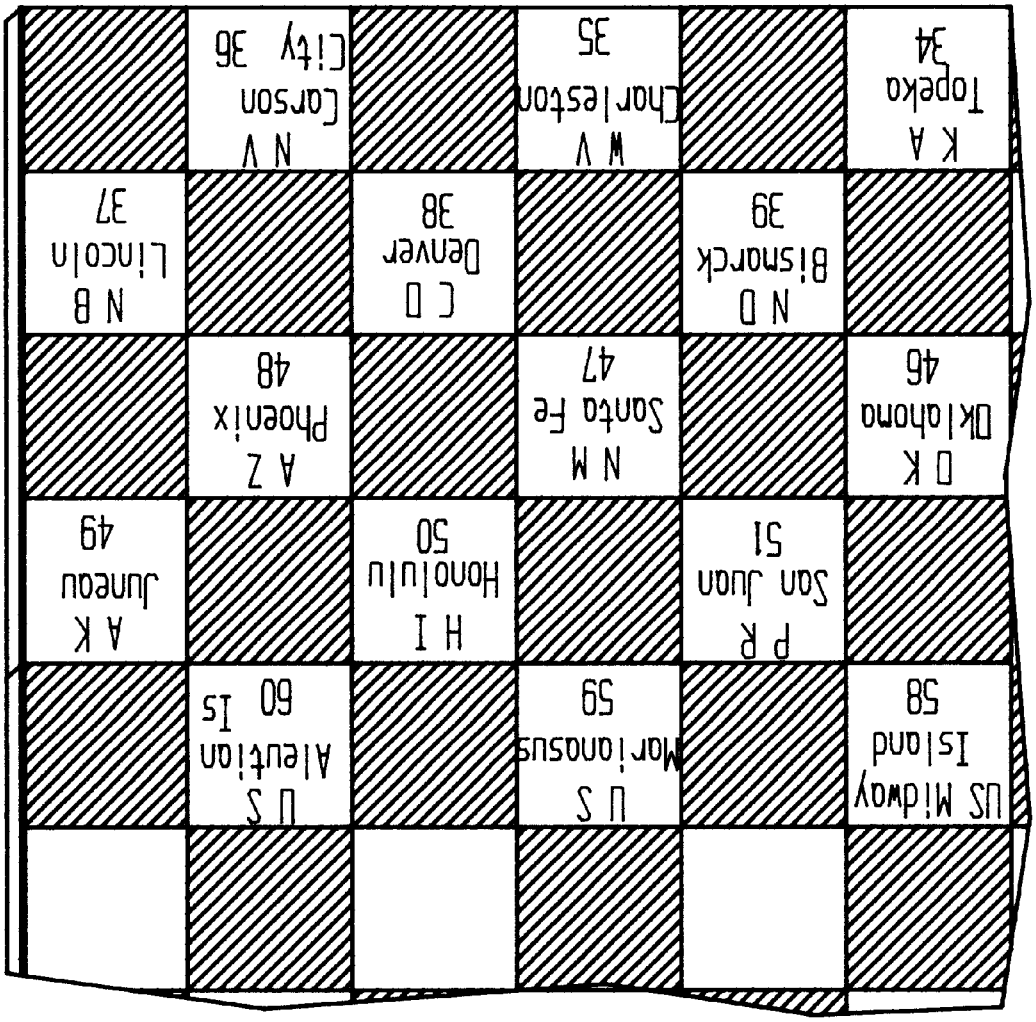
Fig 3 [a]

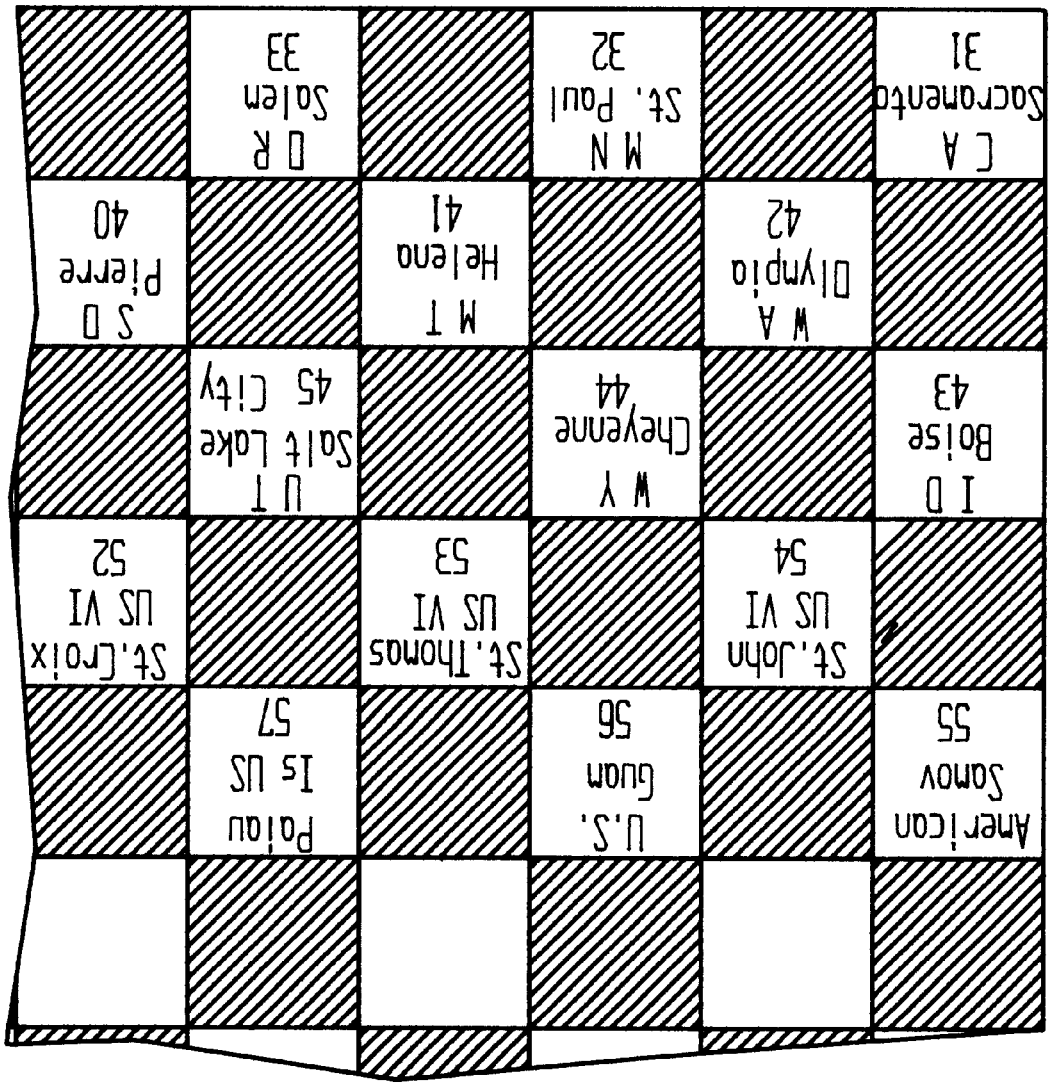
Fig 3 [b]

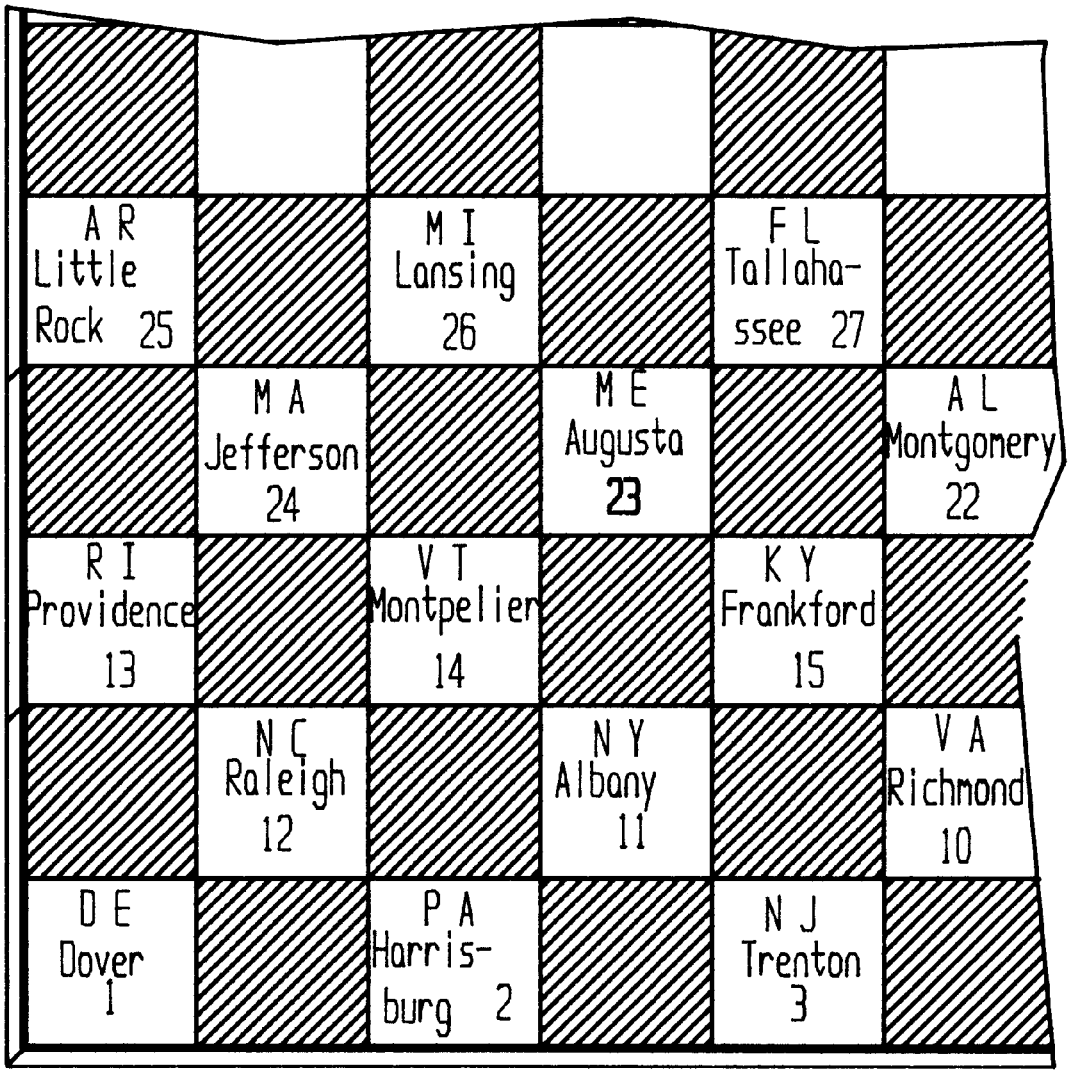
Fig 3 [c]

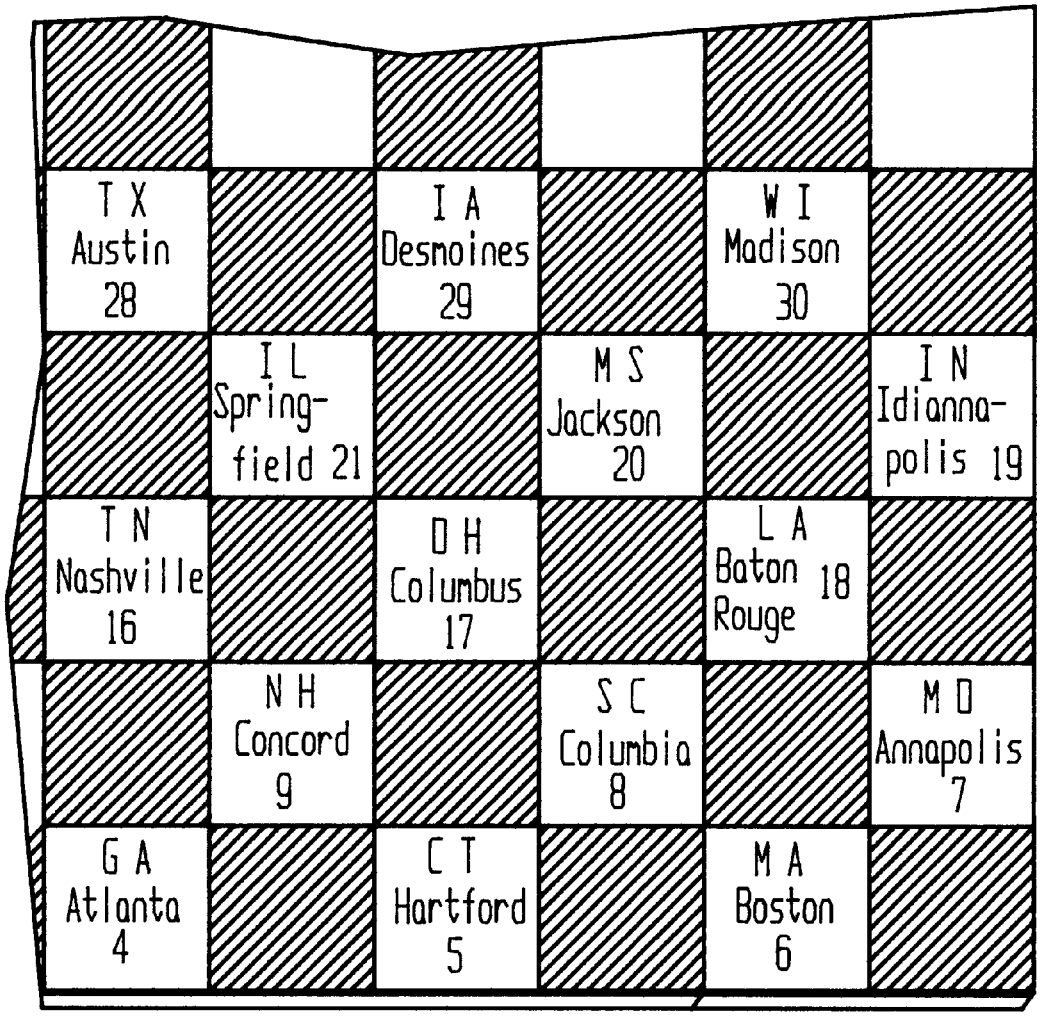
Fig 3 [d]

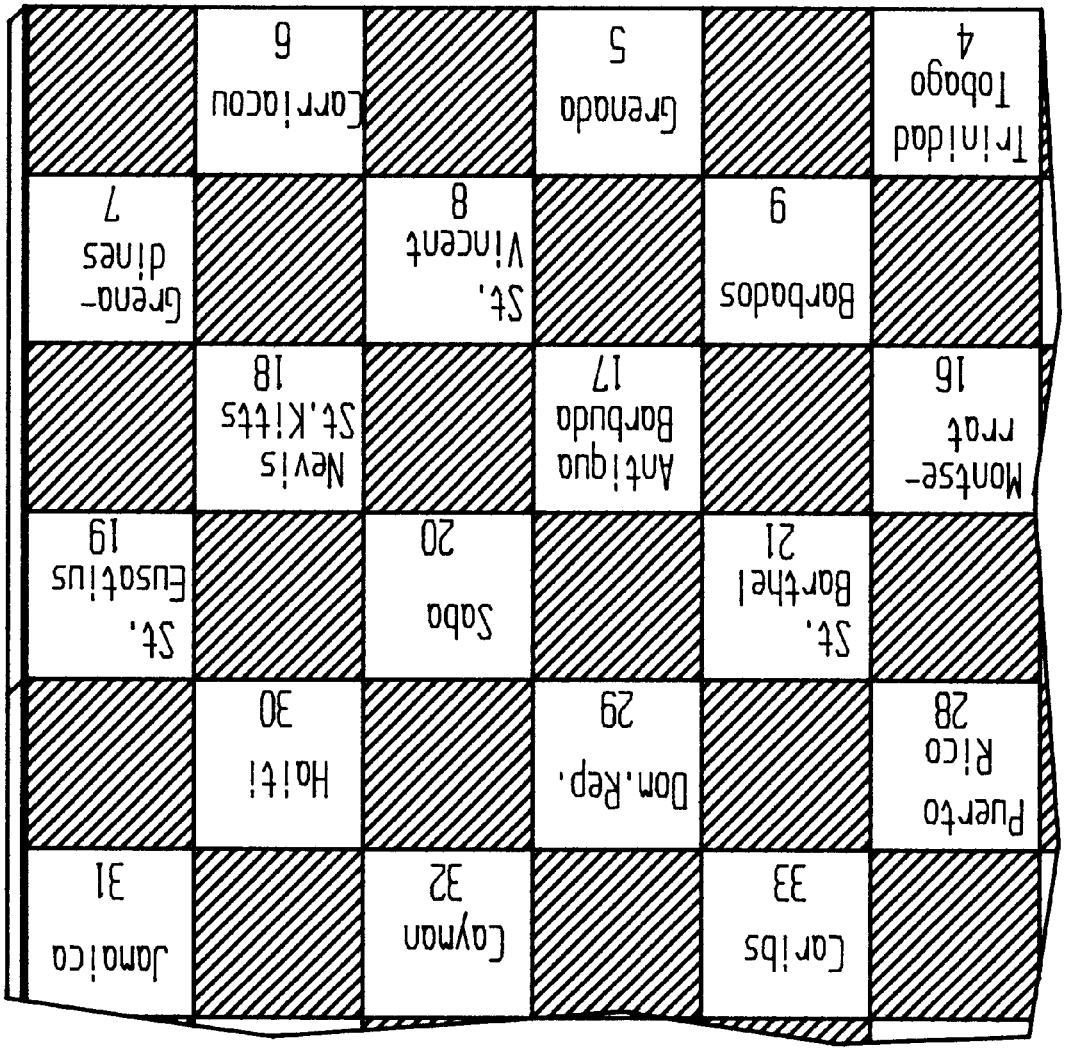
Fig 4 [a]

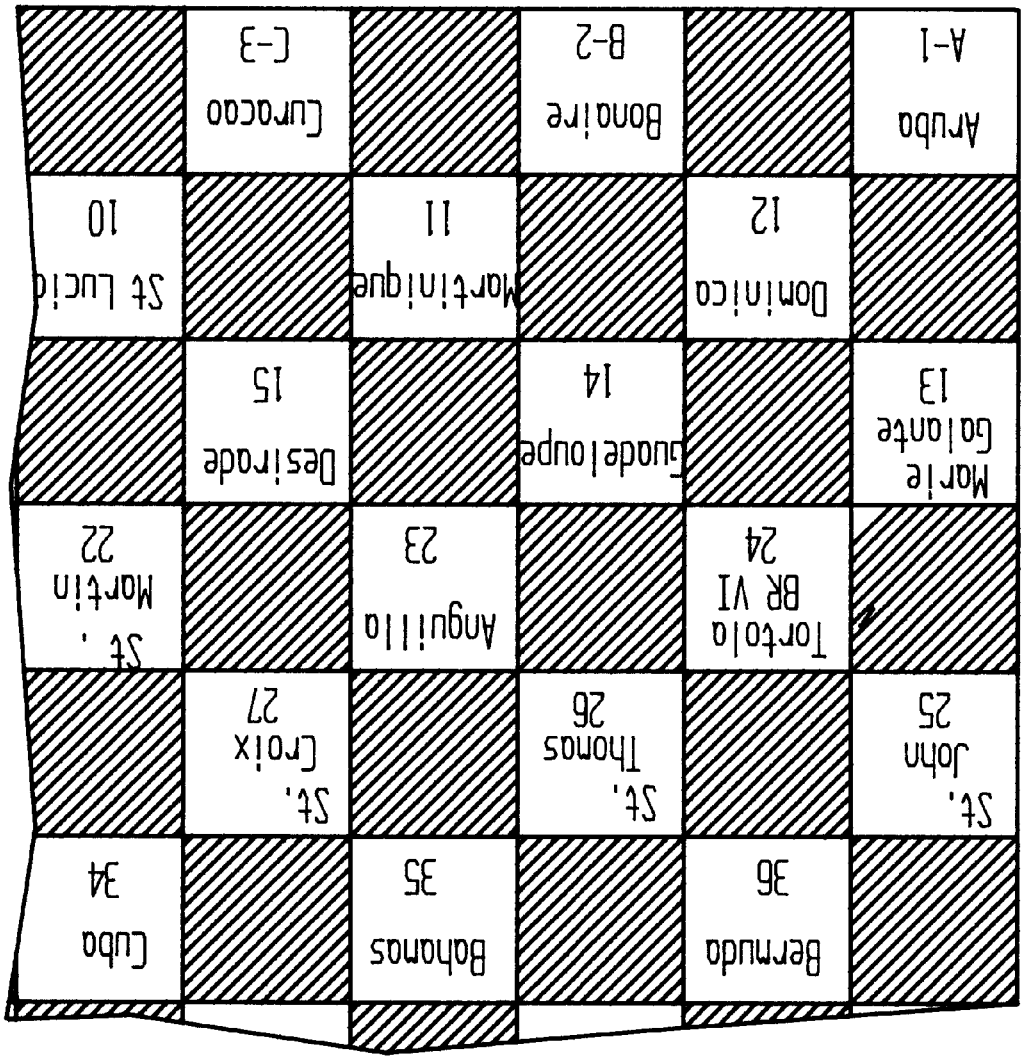
Fig 4 [b]

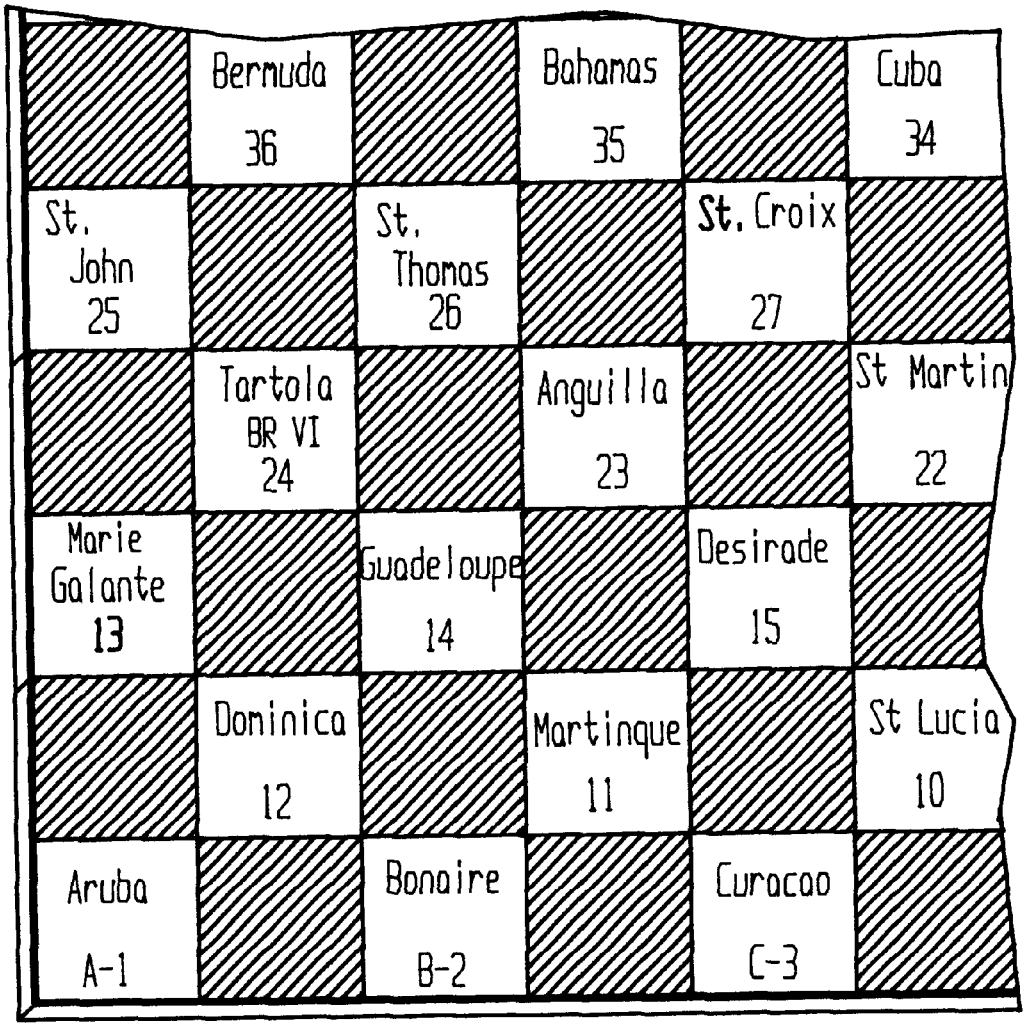
Fig 4 [c]

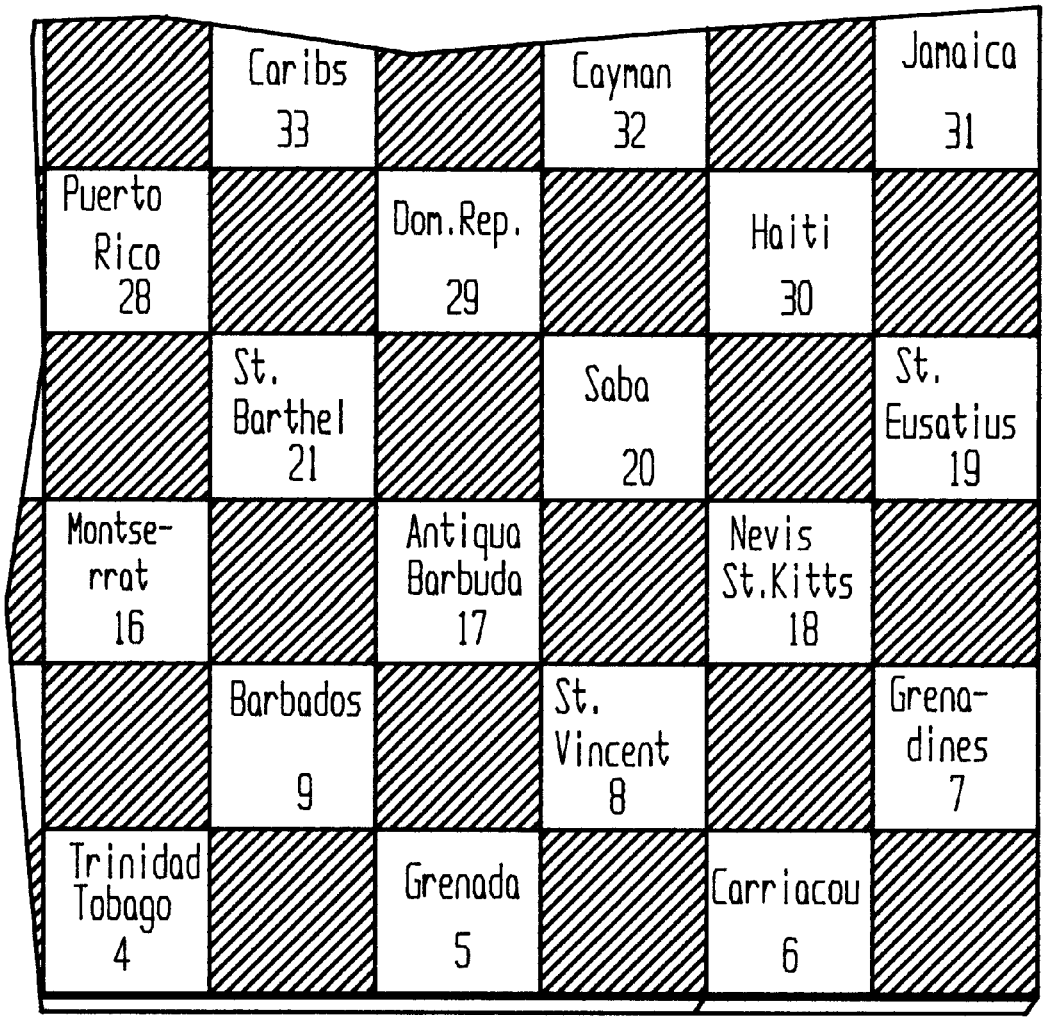
Fig 4 [d]

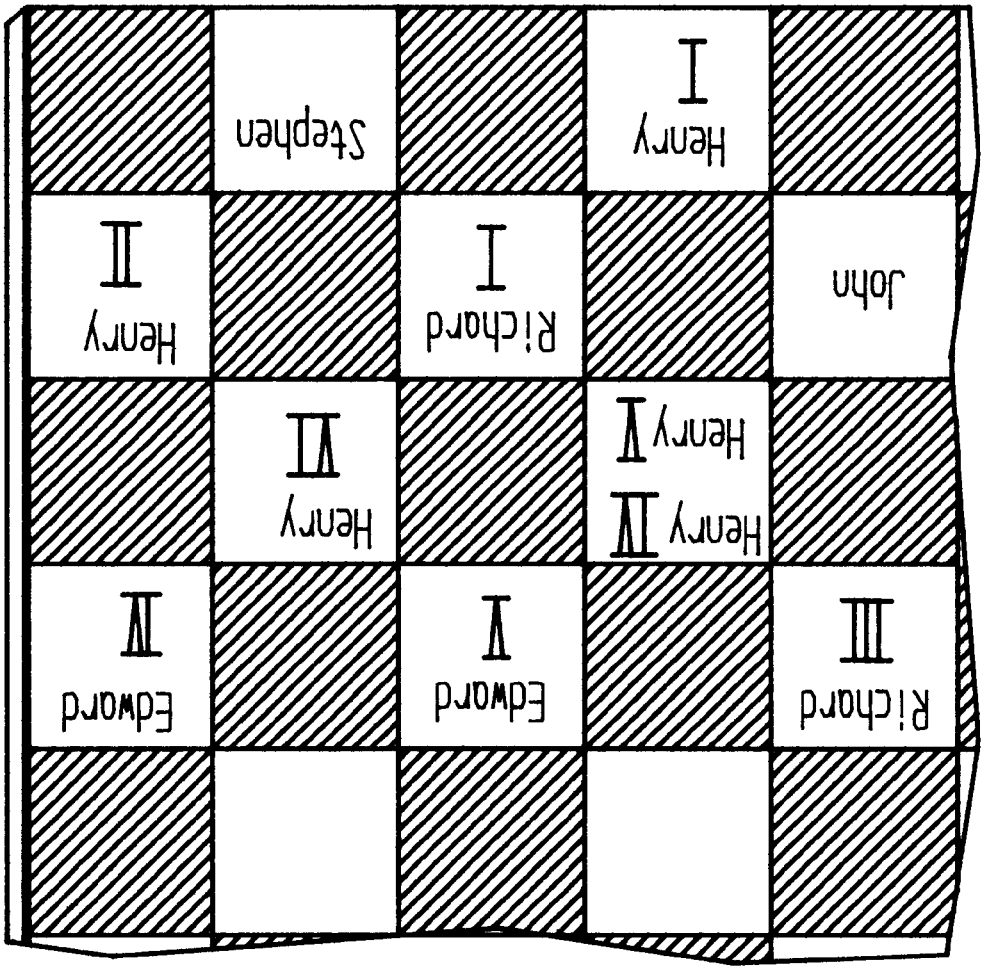
Fig 5 [a]

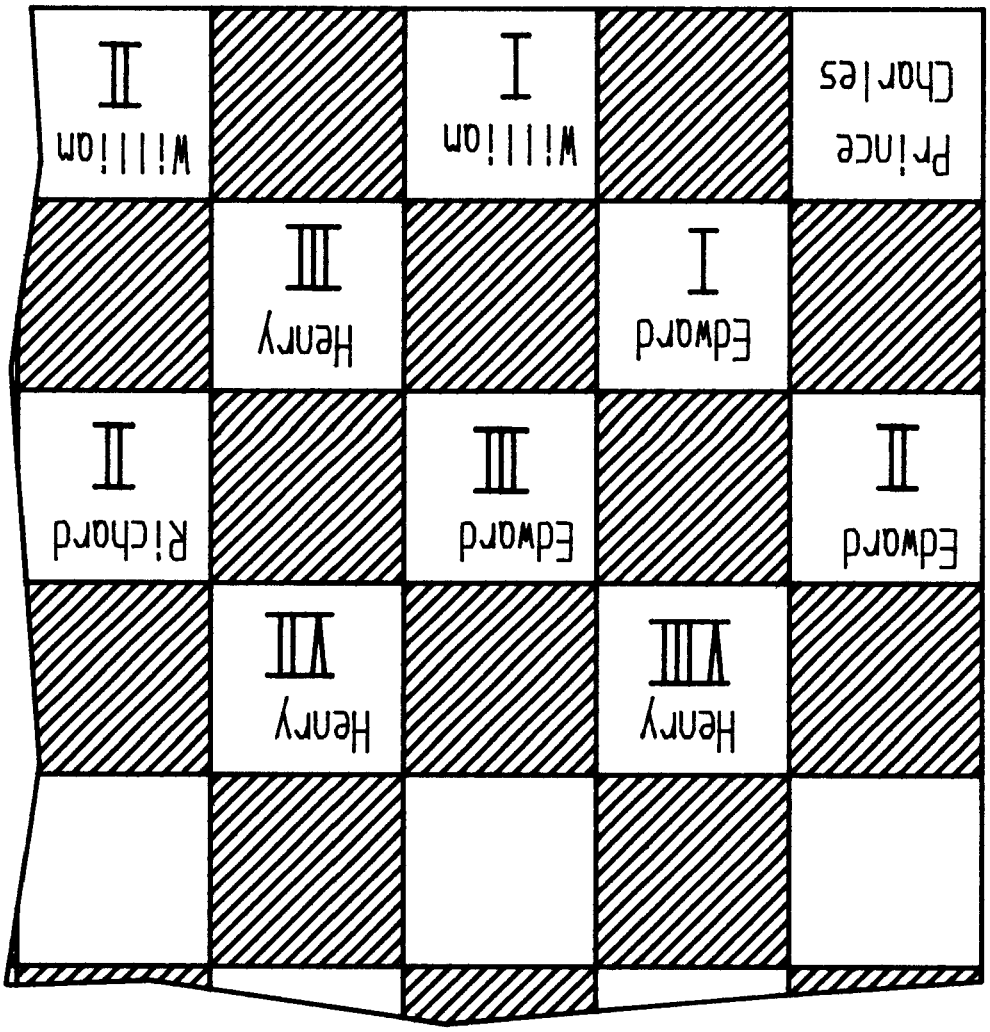
Fig 5 [b]

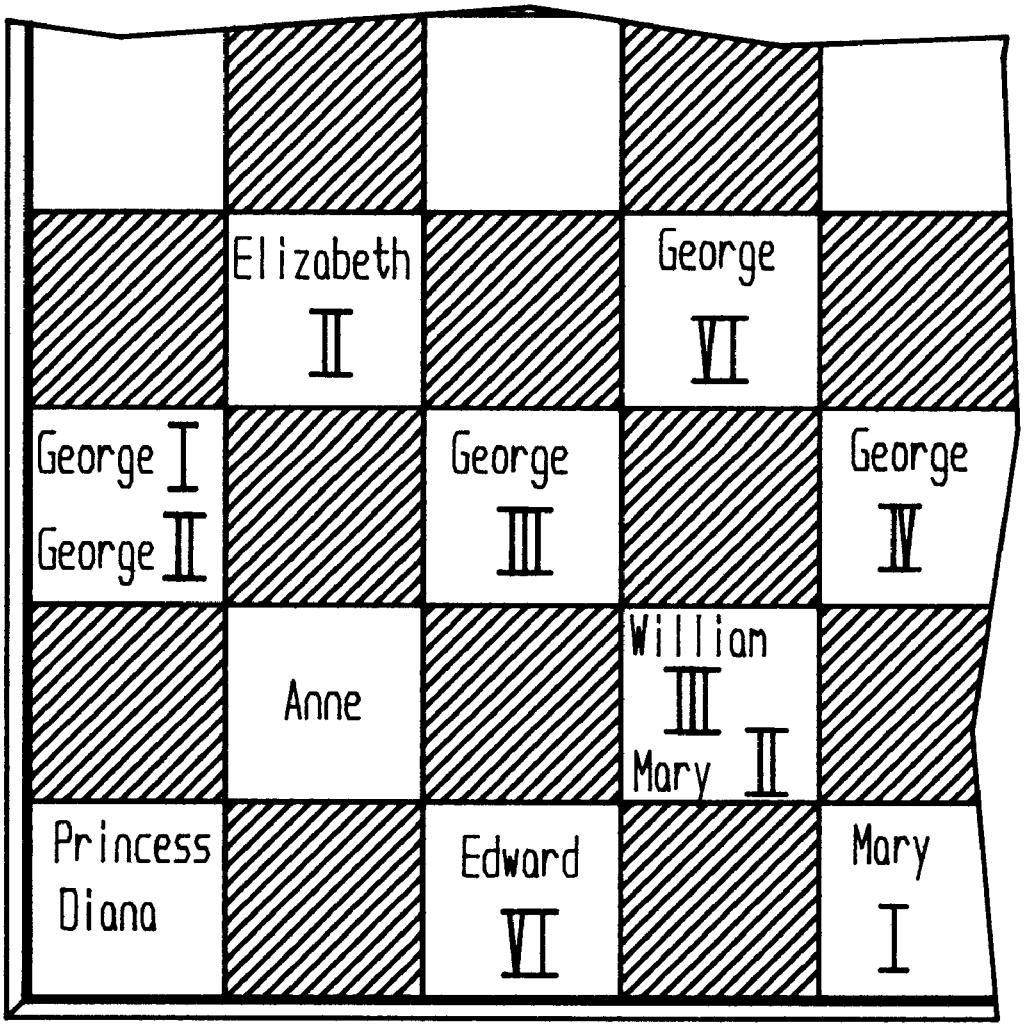
Fig 5 [c]

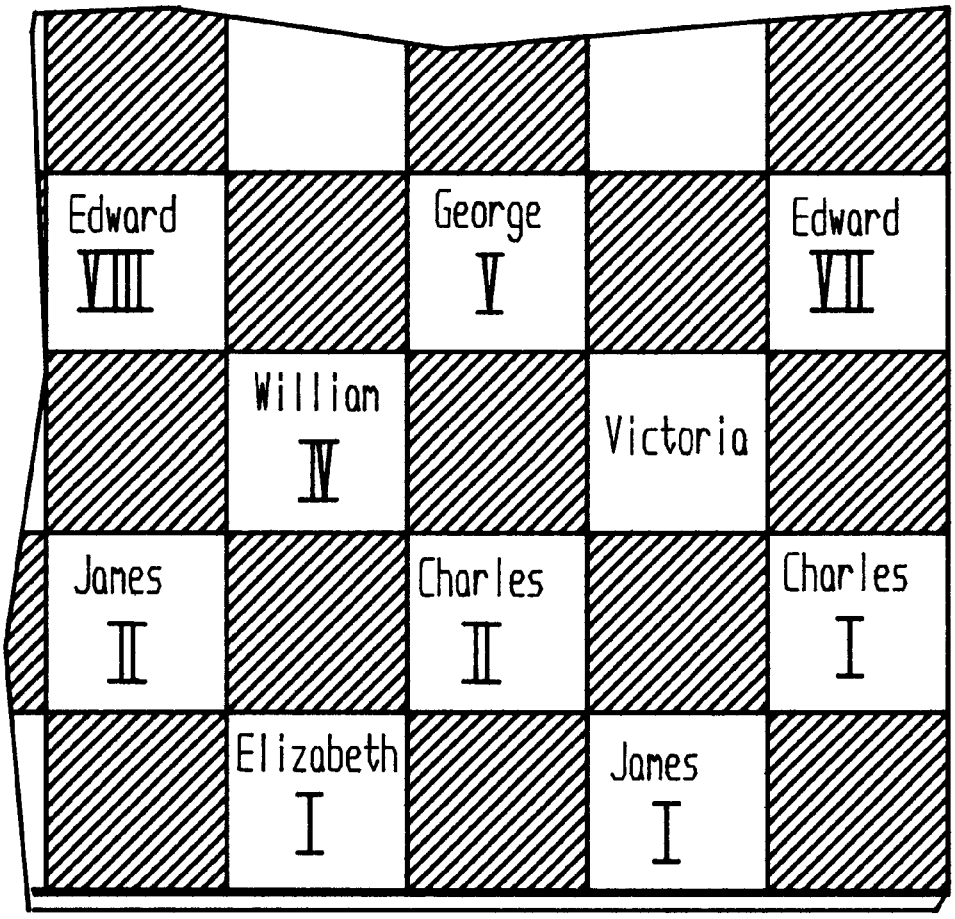
Fig 5 [d]

Fig 6
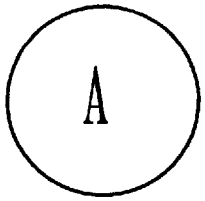
Fig 6 A
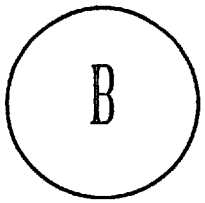
Fig 6 B
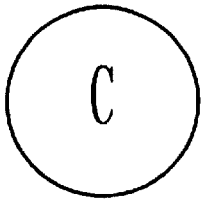
Fig 6 C
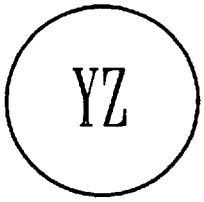
Fig 6 D
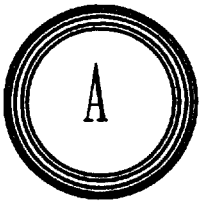
Fig 6 A'
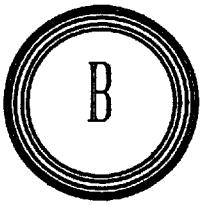
Fig 6 B'
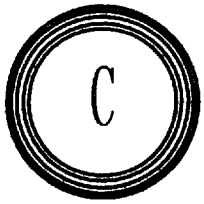
Fig 6 C'
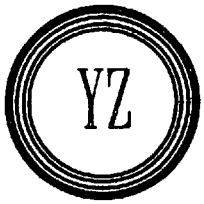
Fig 6 D'
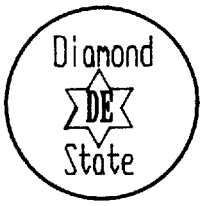
Fig 6 E
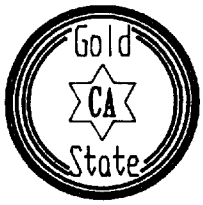
Fig 6 F
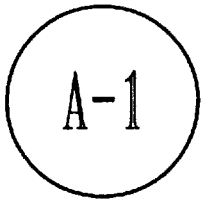
Fig 6 G
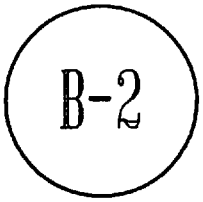
Fig 6 H
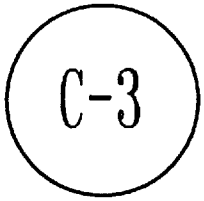
Fig 6 I
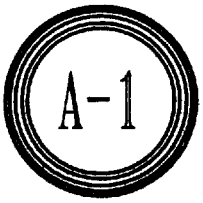
Fig 6 G'
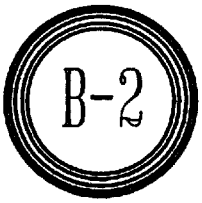
Fig 6 H'
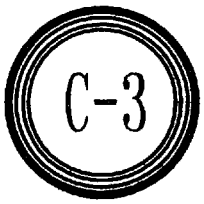
Fig 6 I'

Fig 6 [cont.]

ABC CHECKERS AND OTHER CHECKERS GAMES

BACKGROUND

The present invention relates generally to an A, B, C checkers game for play by two people. Included in this invention are other variations of checkers games involving geographical facts and historical facts and personalities. These games combine the general tactics and game playing skills of checkers with knowledge of various facts and are educational in objective.

In today's society the game of checkers is well known and played internationally. Throughout the years there have been numerous variations and various methods of play. The play of the traditional checkers game involves two players moving game pieces on a firm playing surface divided alternately between differently colored squares, with all play being conducted on spaces of one color. The players sit on opposite sides of the board and alternately move their pieces diagonally in a forward direction. Upon reaching the last row on the board, pieces are crowned becoming "Kings". Kings may move both backwards and forwards diagonally. The object in the traditional game is to eliminate opponent's game pieces from play by jumping them.

The present invention adds a new dimension to this old game. The present invention has a square game board of either 144 or 100 playing squares, thereby enhancing the traditional 64 playing squares. The first 4 to 6 rows of playing squares facing each player have a letter of the alphabet or an abbreviation of a geographical fact or historical fact or personality marked on the surface thereof. The present invention provides both a unique playing strategy and provides an educational stimulus. It also provides for a Super Win opportunity for a player as in each of the games of this invention there are unique or special game pieces that can be used either as a kinged game piece from the commencement of the game or must reach a designated position on the board in order for a player to "win" the game.

A further component of the game is the game pieces also referred to as the checkers. There are 60 game pieces, 30 for each player when there are 144 playing squares or 40 game pieces, 20 for each player when there are 100 playing squares.

Various checker games are known in the art. One such patent discloses a checker game with the game pieces representing mathematical functions for addition, subtraction, multiplication and division. Points are scored for winning the game and for performing the mathematical functions. (See U.S. Pat. No. 5,116,062; Palmer M. Johnson). Another patent discloses a word forming game. (See U.S. Pat. No. 4,289,314; Gary Berlino).

This prior art does not disclose the instant invention.

SUMMARY OF THE INVENTION

The present invention provides a checker board game apparatus for play by two players comprising:

a game board divided into 12 rows of 12 alternate playing and non-playing squares of contrasting colors, a historical fact or personality or geographical fact is imprinted on alternating playing squares of first 5–6 rows facing each player; and 60 game pieces, 30 game pieces for each player.

DESCRIPTION OF THE DRAWINGS

These as well as other features of the present invention will become more apparent upon reference to the drawings wherein:

FIGS. 3[*a*]–[*d*] are a top plan view of a game board depicting United States States and State Capitals;

FIGS. 4 [*a*]–[*d*] are a top plan view of a game board depicting Caribbean Islands;

FIGS. 5 [*a*]–[*d*] are a top plan view of a game board depicting Windsor Monarchy.

DETAILED DESCRIPTION OF THE INVENTION

Figure 1A:
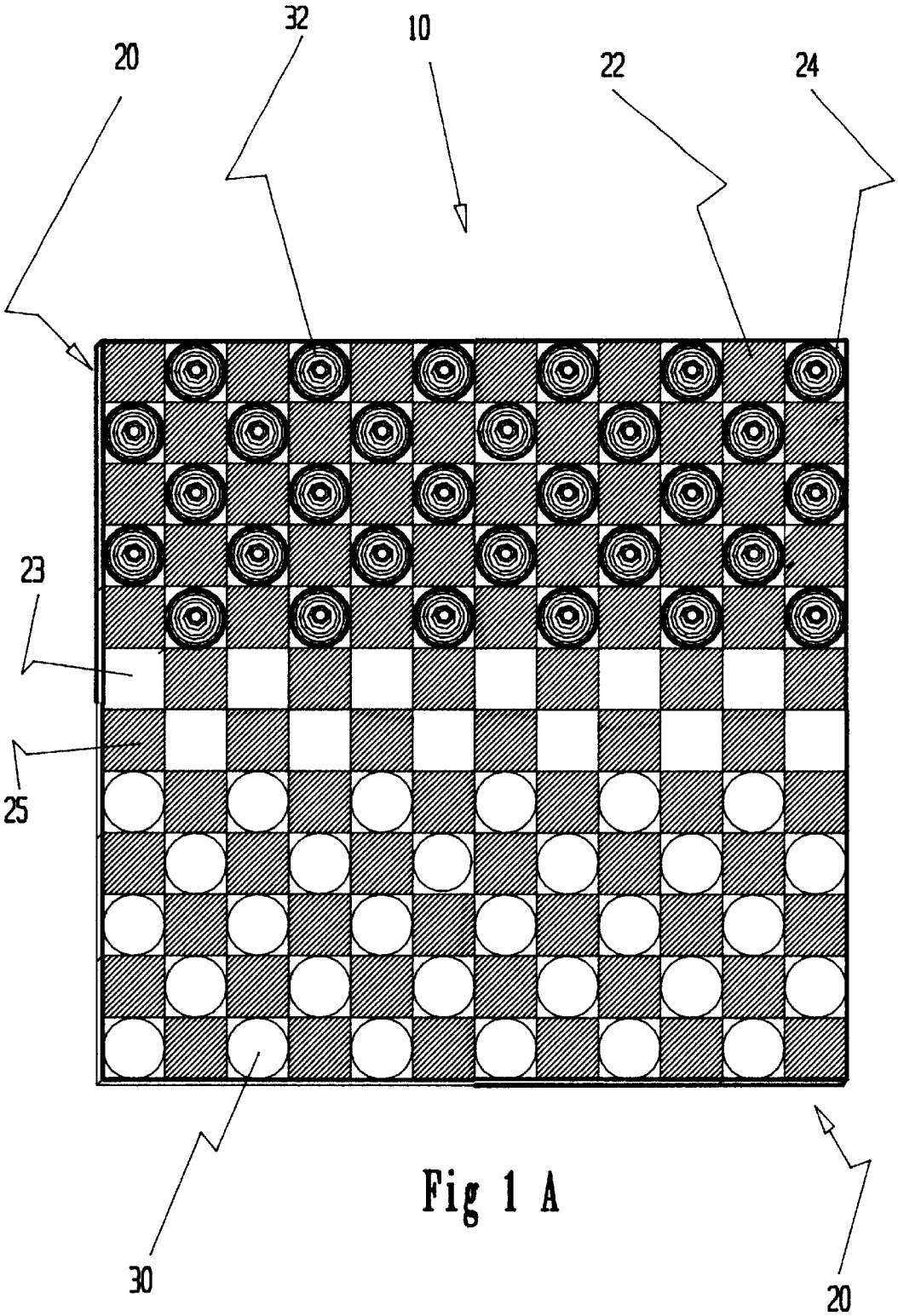
FIGS. 1A and 1B are perspective views of the game board as initially set up to begin play of the game according to a typical embodiment of the present invention.
Figure 1B:
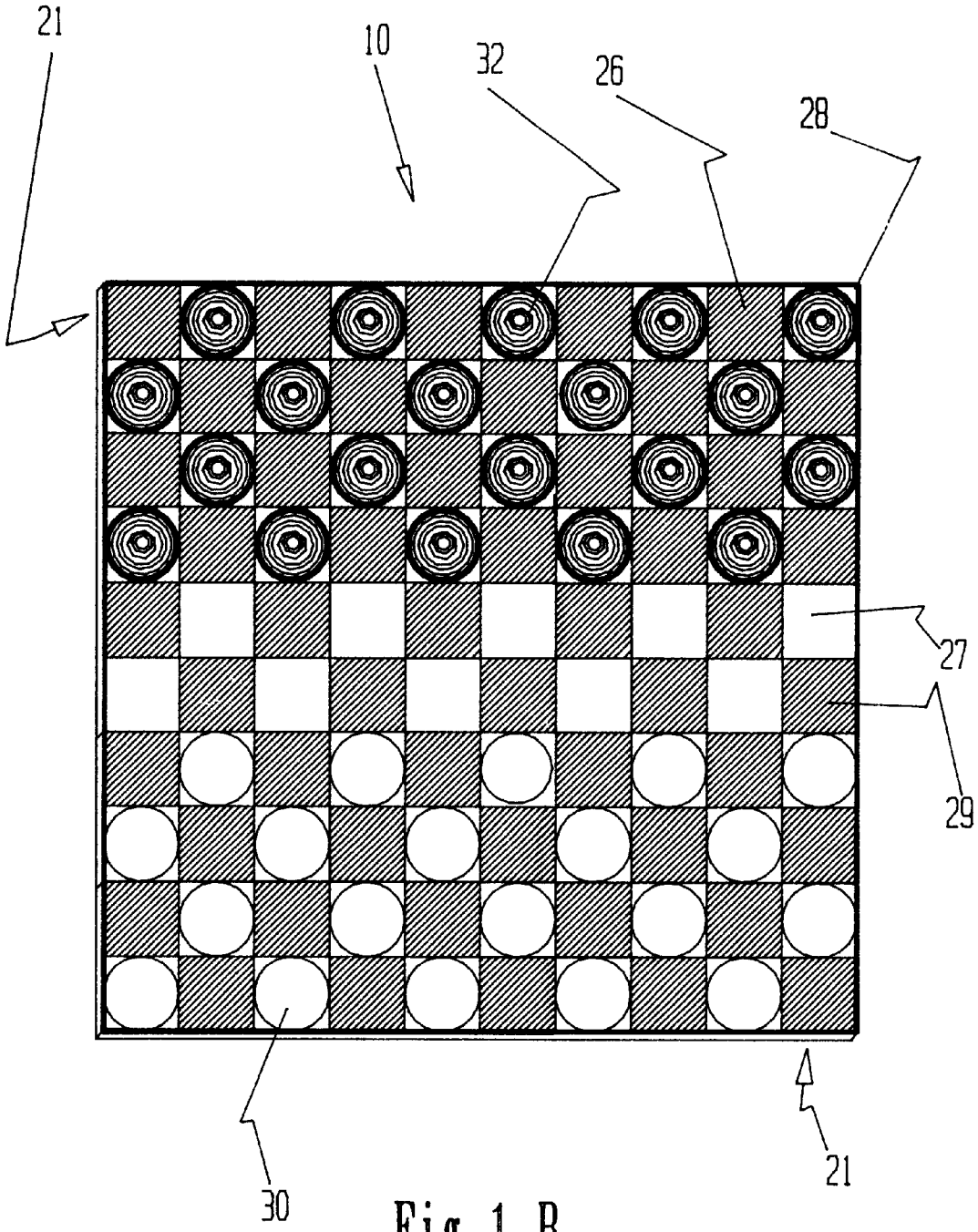
Figure 6J:
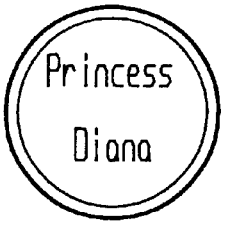
FIGS. 6 [*a*]–[*k*] are a perspective view of special game pieces unique to each of the 4 variations of checkers games of the present invention.
Figure 6K:
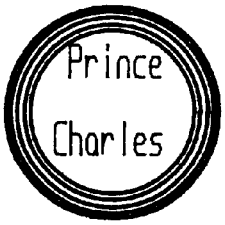

FIGS. 1A, 1B and 6 collectively illustrate the components of the checker game apparatus 10 of the present invention. The game apparatus 10 includes game board 20, 21 of either 144 or 100 squares in an alternating checker board configuration; 60 game pieces consisting of two sets of 30 game pieces when there are 144 playing squares or 40 game pieces, 20 for each player when there are 100 playing squares, the game pieces are also referred to herein as checkers 30, 32.

Game Board 20 is a 12×12 matrix of playing squares 22, 23, 24, 25. Game Board 21 is a 10×10 matrix of playing squares 26, 27, 28, 29.

The playing squares 24 and 28 contain inscriptions, where each such inscription is conformed in such a manner as to face one of the two opposing players whereby each of the opposing players has a full complement of inscribed playing squares facing said player.

The playing squares 22, 23, 24, 25 are organized in 12 rows and 12 columns and playing squares 26, 27, 28, 29 are organized in 10 rows and 10 columns with alternating colors defining playing and non-playing playing squares. The game boards 20 and 21 are configured like a conventional checker board.

The game boards 20, 21 consists of light squares 23, 24, 27, 28 and dark squares 22, 25, 26, 29. Only one color of playing squares will be used at one time. One color squares will be selected as the playing squares and the other color will be designated as the non-playing squares. Further when the playing squares are inscribed, the inscribed squares will be amongst the playing game squares.

It is contemplated that the game boards 20, 21 can be formed of any substantially rigid material such as cardboard, wood or plastic. The game boards 20, 21 may be adapted to fold in a conventional manner at the center thereof for ease in transporting and storing or packaging. The game boards 20, 21 can have a painted surface thereon or alternately may comprise a separately prepared and patterned paper or plastic surface which is affixed to the game boards 20, 21.

Game Pieces 30, 32 include 60/40 game pieces, having 30/20 game pieces of one color and 30/20 game pieces of a second color. FIGS. 6[*a*]–[*k*] describe special game pieces.

The game pieces 30, 32, are cylindrical disks or checker type members of any form or fashion, suitably sized and adapted for the playing squares 22, 23, 24, 25, 26, 27, 28 of the present invention.

FIGS. 1A and 1B depict game apparatus 10 arranged for the start of play. The game pieces 30, 32 are set on the game boards 20, 21 on playing squares. At the beginning of the game players select use of one color of playing squares, thus determining the playing squares for that game.

Play of the game begins with one player moving one of his/her front row game pieces out of that front row in a forward diagonal direction to a contiguous same colored vacant space. Rather than elaborate on all rules regarding movement, directions, jumping and kinging, it should suffice to explain that movement of the game pieces 30, 32, and the rules of play as to jumping, multiple jumps, moving forward unless kinged and getting kinged are the same as the rules for the conventional game of checkers.

Figure 2:
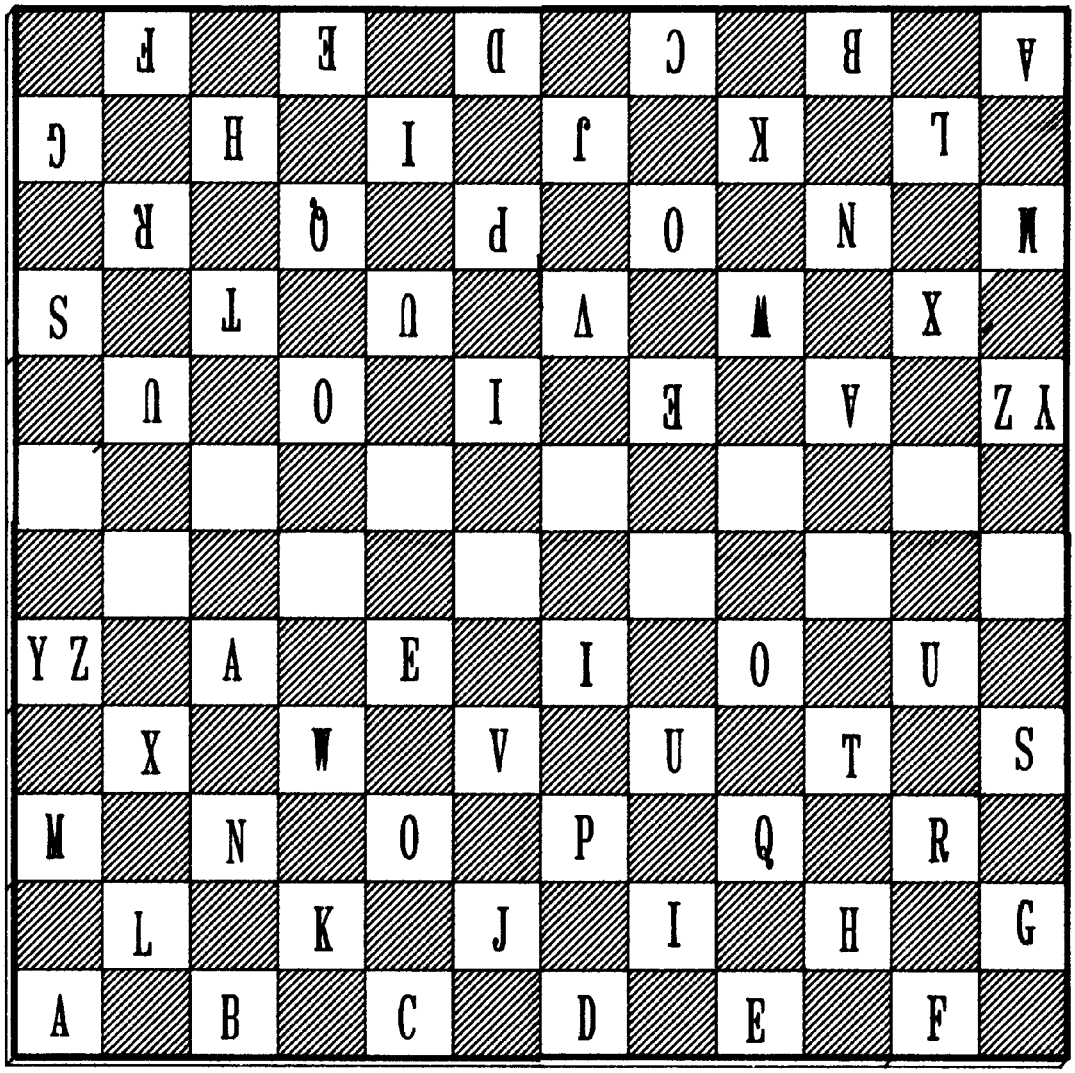
FIG. 2 is a top plan view of a game board depicting A, B, Cs.

Several variations exist in each of the embodiments of the present invention as evidenced by the description of the figures below:

FIGS. 2[*a*]–[*d*] illustrate the ABC version of the present invention. The game board 20 in this embodiment of the invention has a 12×12 matrix of playing squares. The game board is imprinted with the ABC's on alternating playing squares of the first five rows facing each player. Each side has a YZ, square in the far left hand corner of the 5th row. This embodiment has 60 game pieces with each player having A, B, C and YZ imprinted on playing pieces FIGS. 6A–D and 6A'–D' which correspond to playing squares. No other playing pieces have writing thereon. The object of the present invention is to cover the A, B, C squares of the opponent with the corresponding game pieces. The YZ designated playing pieces FIG. 6D and D' are designated as super blockers capable of moving backwards and forwards diagonally in a manner similar to a King in regular checkers. The YZ game piece can move as a king from the beginning of the game. A further objective of the present invention is to eliminate opponents game pieces by jumping. One must jump an opponents game piece in order to remove opponent's game piece from the board. However, the first player to match the A, B and C game pieces on the opponent's A, B and C playing squares wins the game. It may take several rounds to ultimately make an A, B and C match and thus win the game. If the players decide to stop the game before either player has matched all the A, B, C playing squares of opponent, the winner will be determined by the player with the greater of A, B, or C matches. Alternatively, in the event of a tie which ever player has eliminated the greater number of opponent's game pieces shall be the winner.

FIGS. 3[*a*]–[*d*] illustrate the Caribbean Islands version of the present invention. The game board 20 in this embodiment of the invention has a 12×12 matrix of playing squares. The game board is imprinted with a names of Caribbean Islands on the first six rows facing each player. Further on the first row of each player on the far left hand side the designations A1, B2 and C3 are imprinted on the relevant playing squares. This embodiment has 60 game pieces, 30 game pieces for each player with each player having an A-1, B-2, and C-3 imprinted on special playing pieces FIGS. 6G–6I and FIGS. 6G'–6I' which are used to cover the corresponding playing square. No other game piece has any writing thereon. The object of the present invention is to cover the A-1, B-2, C-3 squares of the opponent with player's corresponding special game pieces. A further objective of the present invention is to eliminate opponents game pieces by jumping. One must jump an opponents game piece in order to remove opponent's game piece from the board. If the players decide to stop the game before either player has matched all the A-1, B-2, C-3 playing squares of opponent the winner will be determined by the player with the greater of A-1, B-2, C-3 matches. Alternatively in the event of a tie which ever player has eliminated the greater number of opponent's game pieces shall be the winner. The names of the Caribbean Islands are selected from the group consisting of Aruba, Bonaire, Curacao, Trinidad, Tobago, Grenada, Carriacou, Grenadines, St. Vincent, Barbados, St. Lucia, Martinique, Dominica, Marie Galante, Guadeloupe, Desirade, Montserrat, Antigua, Barbuda, Nevis, St. Kitts, St. Eusatius, Saba, St. Barthel, St. Martin, Anquilla, Gorda, Tartola, St. John, St. Thomas, St. Croix, Puerto Rico, Dominican Republic (Dom. Rep.), Haiti, Jamaica, Cayman, Caribs, Cuba, Bahamas and Bermuda.

FIGS. 4[*a*]–[*d*] illustrate the United States State and State Capitals version of the present invention. The game board 20 in this embodiment of the invention has a 12×12 matrix of playing squares. The game board is imprinted with each U.S. state and state capital on alternating playing squares on the first five rows facing each player. This embodiment has 60 game pieces with one player having a "Delaware—The Diamond State" game piece FIG. 6E and the other player having a "California—The Gold State" imprinted on a playing piece FIG. 6F (CA/Gold State and DE/Silver State) which is used to cover the corresponding state playing square. No other game piece has any writing thereon. An objective of the game is to cover opponent's CA/Sacramento or DE/Dover playing square thus obtaining a Super Win or an instant win. A further objective of the present invention is to eliminate opponents game pieces by jumping. A player must jump an opponents game piece in order to remove opponent's game piece from the board. If the players decide to stop the game before either player has covered opponent's CA/Sacramento or DE/Dover playing square the winner will be determined by the player which has eliminated the greater number of opponent's game pieces. The names of the United States states and state capitals are selected from the group consisting of Dover, Del., Harrisburg, Pa., Trenton, N.J., Atlanta, Ga., Hartford, Conn., Boston, Mass., Annapolis, Md., Columbia, S.C., Concord, N.H., Richmond, Va., Albany, N.Y., Raleigh, N.C., Providence, R.I., Montpelier, Vt., Frankford, Ky., Nashville, Tenn., Columbus, Ohio, Baton Rouge, La., Indianapolis, Ind., Jackson, Miss., Springfield, Ill., Montgomery, Ala., Augusta, Me., Jefferson, Mass., Little Rock, Ark., Lansing, Mich., Tallahassee, Fla., Austin, Tex., Desmoines, Iowa, Madison, Wis., Sacramento, Calif., St. Paul, Minn., Salem, Oreg., Topeka, Kans., Charleston, W. Va., Carson City, Nev., Lincoln, Nebr., Denver, Colo., Bismarck, N. Dak., Pierre, S. Dak., Helena, Mont., Olympia, Wash., Boise, Id., Cheyenne, Wyo., Salt Lake, Utah, Oklahoma, Okla., Santa Fe, N. Mex., Phoenix, Ariz., Juneau, Ak., Honolulu, Hi., San Juan, PR, US VI St. Croix, US VI St. Thomas, US VI St. John, American Samov, Guam, US Paiau IS, US Midway Island, US Marianasus, and US Aleutian IS.

FIGS. 5[*a*]–[*d*] illustrates the Windsors version of the present invention. The game board 21 in this embodiment of the invention has a 10×10 matrix of playing squares. The game board 21 is imprinted with the each member of the Windsor Dynasty on the alternating playing squares on the first four rows facing each player. This embodiment has 40 game pieces with one player having a Princess Diana FIG. 6J and the other player having a Prince Charles FIG. 6K imprinted on a playing piece which is used to cover the corresponding playing square. No other game piece has any writing thereon. One object of this embodiment of the present invention is to cover the Princess Diana or Prince Charles playing square of the opponent with a corresponding game piece 30, 32 thereby obtaining a Super Win or an instant win. A further objective of the present invention is to eliminate opponents game pieces by jumping. One must jump an opponents game piece in order to remove opponent's game piece from the board. If the players decide to stop the game before either player has covered opponent's Princess Diana or Prince Charles playing square the winner will be determined by the player which has eliminated the greater number of opponent's game pieces. The names of the Windsors are selected from the group consisting of Prince Charles, William I, William II, Henry I, Stephen, Henry II, Richard I, John, Henry III, Edward I, Edward II, Edward III, Richard II, Henry IV, Henry V, Henry VI, Edward IV, Edward V, Richard III, Henry VII, Henry VIII, Princess Diana, Edward VI, Mary I, Elizabeth I, James I, Charles I, Charles II, James II, Mary II, William III, Anna , George I, George II, George III, George IV, William IV, Victoria, Edward VII, George V, Edward VIII, George VI and Elizabeth II.

FIGS. 6[*a*]–[*k*] illustrate the special game pieces of the present invention. As previously described special game pieces 30, 32 are inscribed with indicia relevant to the movement of that game piece or special character of the subject game piece.

Changes and modifications in the specifically described embodiments can be carried out without departing from the scope of the invention which is intended to be limited only by the scope of the appended claims.

What is claimed is:

1. A board game apparatus for play by two players comprising:

a game board divided into 12 rows of 12 alternate playing and non-playing squares of contrasting colors, imprinted with A, B, C's on alternating playing squares of first 5 rows facing each player; and 60 game pieces, 30 game pieces for each player wherein each side of the game board has an "YZ" square in far left hand corner of 5th row, the 60 game pieces include 2 special game pieces marked "YZ", one for each player, 2 special game pieces marked "A", one for each player, 2 special game pieces marked "B", one for each player, and 2 special game pieces marked "C", one for each player.

2. A board game apparatus according to claim 1 wherein the game pieces marked YZ are positioned at a left hand position on fifth row facing each player.

3. A board game apparatus according to claim 2 wherein the game pieces marked YZ can move backwards and forwards.

* * * * *